US005548926A

United States Patent [19]

Sjöholm

[11] Patent Number: 5,548,926

[45] Date of Patent: Aug. 27, 1996

[54] HINGE ARRANGEMENT, AND USE THEREOF

[76] Inventor: Jarmo Sjöholm, Hovitie 20, Vantaa, Finland, 01380

[21] Appl. No.: 211,588

[22] PCT Filed: Oct. 13, 1992

[86] PCT No.: PCT/FI92/00273

§ 371 Date: Apr. 5, 1994

§ 102(e) Date: Apr. 5, 1994

[87] PCT Pub. No.: WO93/08355

PCT Pub. Date: Apr. 29, 1993

[30] Foreign Application Priority Data

Oct. 14, 1991 [FI] Finland ..... 914848

[51] Int. Cl.[6] ..... E05D 15/26

[52] U.S. Cl. ..... 49/127; 49/125

[58] Field of Search ..... 49/125, 126, 127, 49/128, 394; 160/37, 201

[56] References Cited

U.S. PATENT DOCUMENTS

| | | | |
|---|---|---|---|
| 795,539 | 7/1905 | Parmelee . | |
| 3,052,000 | 9/1962 | Ferrett | 49/127 X |
| 3,060,521 | 10/1962 | Greco | 49/127 X |
| 3,303,612 | 2/1967 | Baker | 49/127 |
| 3,733,749 | 5/1973 | Parera . | |
| 3,810,330 | 5/1974 | Daggy | 49/127 |
| 4,452,012 | 6/1984 | Deal . | |
| 4,888,915 | 12/1989 | Goldenberg . | |
| 5,272,839 | 12/1993 | Karhu | 49/127 X |

FOREIGN PATENT DOCUMENTS

| | | |
|---|---|---|
| 84645 | 9/1991 | Finland . |
| 9100636 | 9/1991 | Sweden . |
| 467884 | 9/1992 | Sweden . |
| 207184 | 12/1939 | Switzerland . |
| 208483 | 5/1940 | Switzerland . |

*Primary Examiner*—Jerry Redman

[57] ABSTRACT

A hinge arrangement for hinging a sliding element (2) movable in guidance of, and carried by, a pair of fixed guide sections ($1^1$, $1^2$) for turning about a hinge axle (3) affixed to the sliding element. The hinge arrangement comprises a first coupling member (4), connected to the hinge axle (3), and a second coupling member (5), connected to the guide section ($1^1$, $1^2$), and the first coupling member and the second coupling member are arranged to become coupled with each other when the first coupling member is in register with the second coupling member, and thus to lock the hinge axle (3) relative to the guide section to be substantially immovable, for the turning of said sliding element.

7 Claims, 4 Drawing Sheets

HINGE ARRANGEMENT, AND USE THEREOF

BACKGROUND OF THE INVENTION

The present invention relates to an improved hinge arrangement and in particular, to an improved hinge arrangement having an improved locking mechanism and having a freely selectable pivot point.

Hinge arrangements are known in the prior art for pivotally mounting a sliding element, which can be moved in guidance and support by a stationary pair of guide sections, to be turnable about a hinge axle attached to the sliding element. A typical sliding element system comprises a plurality of rectangular sliding elements, each element presenting a first side and a second side, substantially parallel to each other. Guide wheel sets are attached on the first side and on the second side of the sliding element. The system further comprises a pair of guide sections, mounted to be stationary and comprising a first guide section disposed adjacent to the first side of the sliding element, and a second guide section disposed adjacent to the second side of the sliding element, the guide wheel sets running in guidance of these guide sections. The sliding elements are carried by the guide sections one after the other and they can be moved as desired in guidance of said guides.

Since the movable sliding elements have no actual fixed hinge location, as is the case with common windows for instance, hinging them has caused problems in regard of adequately supporting the glass and in view of easy and convenient use.

In the prior art it is known, e.g. in connection with balcony glass pane systems, to have guides curving out from the guide section proper and guiding and carrying the sliding glass element, with the aid of which the element can be turned into its open position in which the sliding element is positioned at an angle against the principal transporting direction taking place along the guide sections.

Installation of separate curved guides imposes limitations on the installation of the sliding element such as balcony glass panes, because the curved guide is that part of the system which carries the glass. Therefore, the curved guide must invariably be supported at a point which can take up the weight of the glasses. On balconies where the glassing does not extend to the balcony slab above, or on balconies altogether lacking a roof, installation of the system under consideration is difficult or outright impossible. Moving and opening the panes along the curved guide is awkward and implies quite careful moving of the glass pane along the curve. Even then, panes of great height will not always find enough support, and they must therefore be steadied with the hand when they are being opened. Manufacturing the curved guide is an extra component involving expenses. The direction in which the balcony panes open cannot be changed afterward because the curved guide is permanently mounted. This introduces a risk factor of some degree in the dimensional designing of balcony glasses because the handedness must be particularly minded.

In the prior art it is also known to have a separate locking part in conjunction with the upper guide wheel set, moving along with the sliding element, this locking part becoming attached to the guide wheel set of another glass pane when they meet. In balcony glass systems which employ such a separate locking piece inside the carrying section, locking is accomplished by pushing the piece before or behind the openable glass pane. Since the piece always moves along with the glass pane, it brakes the motion of the panes and it is a part subject to wear. Passage of the piece through sharp angles is not feasible, and therefore they are not fit to be used on angular balconies. It is true, though, that many of the balcony glass systems found in the marketplace are even otherwise unable to pass through angles, instead of which the opening of the glass panes must be in two directions.

Neither of the hinging arrangements discussed can be used in applications where its is desired to implement the locking of the panes for turning in such a way that part of the element would open at a point about the middle of the guide sections, or at another arbitrarily selected point relative to the guide section. It is thus understood that locking of the element to be immovable, and its hinging, must always be arranged at the ends of the sections.

Another shortcoming of existing hinge arrangements is their inflexibility as regards to selection of the opening point, and thus of the point where the hinges are provided. Moreover, said hinge arrangements require such stability of the upper sections' fastening that opening of the sliding elements becomes possible in the first place. In those arrangements which are being used at present, locking of the lower parts of the elements is not feasible in the same manner: they are either left without support or some other arrangement has to be applied in their case. When the sliding element is a sheet of glass, as it is in balcony glass systems, hinge arrangements of prior art fail to afford sufficient support to the panes when they are opened, and the panes always make a somewhat flimsy impression.

It is a further problem that the manufacturing, and installation, of hinge arrangements in present use requires several distinct work steps.

SUMMARY OF THE INVENTION

A hinge arrangement in accordance with the invention includes comprises a first coupling member which is connected to a guide section. This first coupling member and a second coupling member are arranged to become coupled with each other when the first coupling member is in register with the second coupling member, and thereby to lock a hinge axle to be substantially immovable relative to the guide sections, for turning the sliding element.

A sliding element is understood to be any kind of structural element which has been disposed to be movable, carried by guides. Such elements are. for instance, sliding window elements, sliding door elements, or the like. The sliding elements may be installed to be vertical, horizontal, or at any desired angle. Likewise, their sliding may take place vertically, horizontally or in any other direction, depending on the application. One specific application is that of balcony glass enclosure systems, in the case of which a balcony is isolated from ambient air by means of slidable, and openable, glass elements.

The hinge arrangement of the invention introduces a decisive improvement as regards sturdiness of the locking, and free selection of the pivot point. The work involved in manufacturing as well as installation will be easier and faster when hinging components according to the invention are employed because the components can be mounted on the sections at the works already.

In an embodiment of the arrangement, the hinge arrangement comprises a coupling piece which is attached to the guide section, and on which coupling piece one of the two coupling members is provided. The coupling piece may for instance be attached on the length of the section at any desired point.

In an embodiment of the arrangement, the first coupling member comprises a slide member on the hinge axle, and the coupling piece comprises a guide which together with the slide member constitutes a pair of guides for guiding the hinge axle into coupling engagement with the other coupling member. The slide member is advantageously a chisel-shaped portion formed on the end of the hinge axle, and the guide is a slot receiving said chisel-shape portion in itself. When the hinge axle is round of its cross section, the chisel-shaped portion on the end of the hinge axle is obtained by removing therefrom parts with segment-shaped cross section, on opposite sides symmetrically with reference to the central axis of the hinge axle and over a given length on the end of the hinge axle.

In an embodiment of the arrangement, the second coupling member comprises a round turning sleeve with a diametral slot passing through it, fitted to receive the slide member in itself; and the coupling piece comprises a first recess in which the turning sleeve is disposed to turn.

In an embodiment of the arrangement, the coupling piece comprises, in consecutive succession, two or more second coupling members. There may be several coupling pieces provided in succession, and therefor may be provided interconnecting fixing elements.

In an embodiment of the arrangement, the first coupling member comprises a locking pin disposed inside the hinge axle, a first compression spring for urging said locking pin outward into a position in which it is pushed out from the hinge axle, and a first locking member for locking the locking pin in its pushed-in position against the spring bias; the arrangement comprises a first releasing member for releasing the locking member and allowing the locking pin to assume a pushed-out position; and the second coupling piece comprises a second recess formed in the coupling piece for receiving the locking pin in said recess.

In an embodiment of the arrangement, the first coupling member comprises a pointed second locking pin disposed inside the hinge axle, a second compression spring serving to urge the locking pin outward into a position pushed out from the hinge axle, and a second locking member for locking the pin in its pushed-in position against the spring bias; and the second coupling member is the surface of the guide section, against which the second locking pin is urged in its pushed-out position and with which the pointed end of the pin becomes engaged.

In an embodiment of the arrangement, the second coupling member is disposed to engage with the guide section in connection with any turning of the sliding element, and in any other situation to move along with the sliding element as this is being moved along the guide sections.

In an embodiment of the arrangement, the first coupling member comprises the end of the hinge axle, and the second coupling member comprises a pin or its like, disposed to receive in itself the end of the hinge axle and arranged to be turnable in a third recess in the coupling piece, a third compression spring for urging the pin outward from the recess into a pushed-out position, and a third locking member for locking the pin in its pushed-in position against the spring bias; and that the arrangement comprises a second releasing member for releasing the pin to assume the pushed-out position for coupling with the end of the hinge axle.

The hinge arrangement can be used in connection with any sliding elements whatsoever which are movable in guidance of, and carried by, guides, such as windows, doors, glass doors, panel doors, walls, partitions, roof elements, shelter tops, hatches, etc., in residential and industrial buildings, land vehicles and marine conveyances.

The most important advantage of the invention can be seen in the fact that the opening and use of sliding elements are facilitated and become safer than before, because the sliding elements need not be conveyed along any guide section, e.g. curved ones, when they are being opened. If required, the same locking system can be used on both sections of the pair of guide sections, whereby a highly stable structure is achieved. Since the locking part is, most advantageously, fixedly installed, it will not obstruct the moving of elements past angulation points either.

BRIEF DESCRIPTION OF THE DRAWINGS

In the following the invention is described in detail, with reference to the attached drawing, wherein.

DETAILED DESCRIPTION

Figure 1:
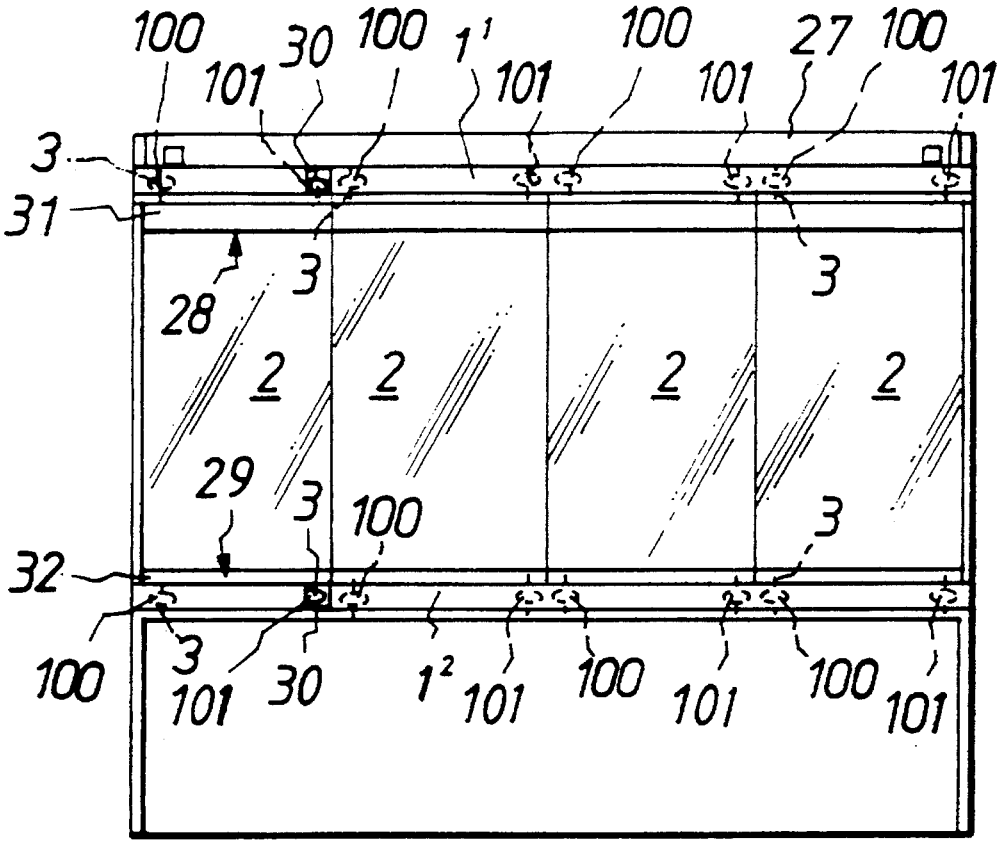
FIG. 1 presents a balcony glass pane system, schematically and viewed in front, from the balcony.

In FIG. 1 is depicted a balcony glass pane system wherein sliding elements 2, that is in this case balcony glass pane elements 2, are installed to be carried by an upper guide section $\mathbf{1}^1$ and a lower guide section $\mathbf{1}^2$, between these sections. The upper guide section $\mathbf{1}^1$ may be affixed to the balcony slab 27 of the balcony immediately above, straight from below, or to an extension of the upper balcony's railing which protrudes partly into the lumen aperture of the lower balcony. The lower guide section $\mathbf{1}^2$ is affixed to the railing of the lower balcony.

Figure 3:
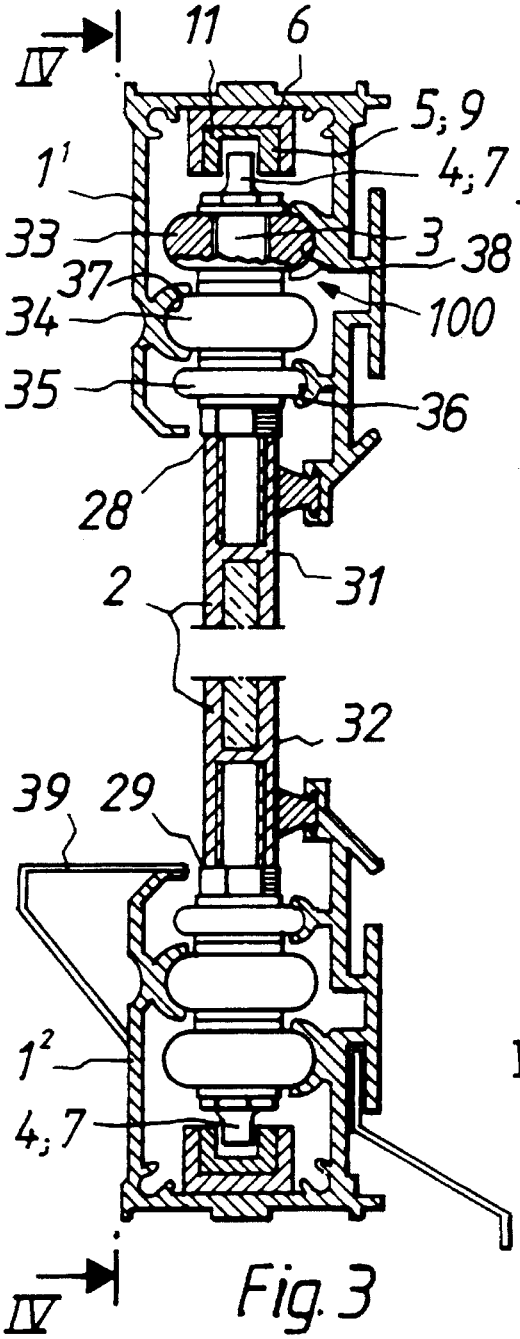
FIG. 3 presents, in vertical section, one sliding element of a balcony glass pane system and a first embodiment of the hinge arrangement of the invention.
Figure 4:
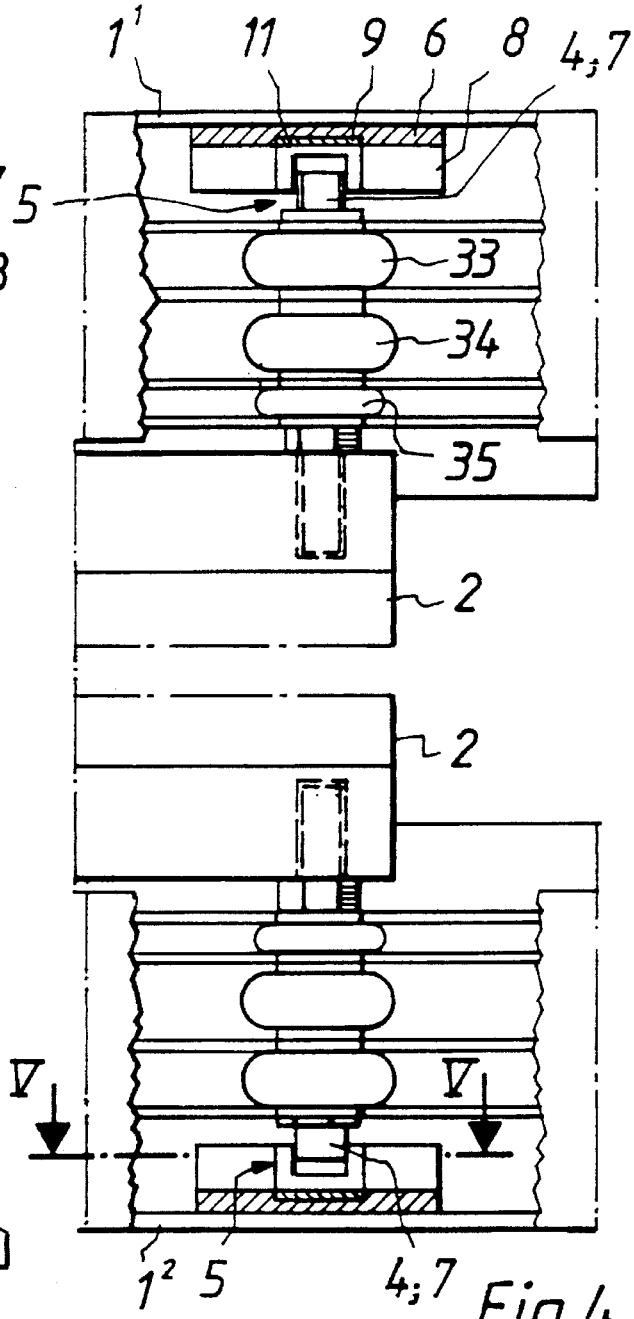
FIG. 4 shows the sliding element of FIG. 3, as seen in the direction IV—IV of FIG. 3.

The balcony glass pane element 2 is a rectangular sliding element, adjacent to the corners of its top side 28 and bottom side 29 being affixed guide wheel sets 100 and 101, the wheel set 100 on the hinge side being shown in greater detail in FIGS. 3 and 4. The guide wheel sets 100 and 101 enable the glass elements 2 to be moved, carried by the pair of guide sections $1^1$,$1^2$, in the direction defined by the guide sections.

Each glass element 2 can be opened in side-hinged fashion by turning the glass element 2 about its hinge axle 3 so that the guide wheel set 101 comes out through apertures 30 provided in the guide sections $1^1$ and $1^2$. The hinge axles 3 on the top side and the bottom side are in register and at right angles against these sides. The hinge axle constitutes, in addition to its hinge axle function, the axle of the guide wheel set 100, and therefore the wheels of the guide wheel set 100 rotate in a plane which is at right angles against the plane of the glass element 2. When the guide sections $1^1$ and $1^2$ are horizontal and the glass element 2 is vertical and therefore moves horizontally, the hinge axle 3, which is the rotation axle of the guide wheel set 100 at the same time, will be vertical. An advantageous arrangement of guide section and guide wheel sets of this type is more closely described in the Finnish patent application No. 911478 by the same applicant, and in the following with reference to FIGS. 3 and 4.

Figure 2:
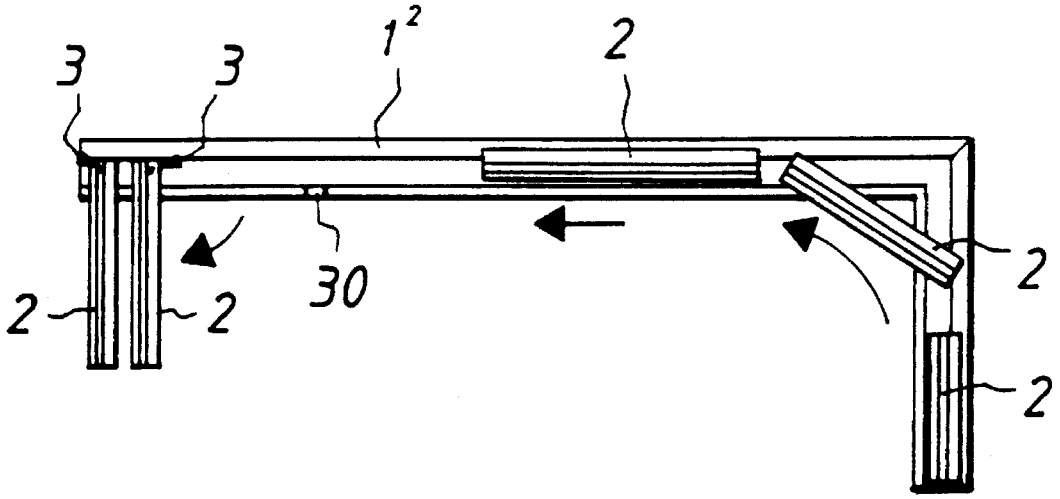
FIG. 2 presents the balcony glass pane system, horizontally sectioned, and showing two glass panes which have been opened on side hinges.

The horizontal sectional view in FIG. 2 reveals that the glass elements 2 are turned to be positioned side by side, whereby they will each time come closer to the opening apertures 30 by the amount of their thickness. For this reason the wheels 101 on the opening side, mounted on the frame sections 31 and 32 of the glass elements, are in each case advanced by this amount toward the hinge side. The arrangement of the guide wheel sets 100,101 described in the Finnish patent application No. 911478, cited above, and described in the foregoing, affords the possibility that the glass elements 2 can also pass through sharp angles, as illustrated in FIG. 2.

In FIG. 3 is shown, in vertical section, one sliding element 2 of the balcony glass pane system with its guide sections. FIG. 4 shows the same, viewed in the direction IV—IV indicated in FIG. 3, part of the guide sections having been cut off for greater perspicuity. It is seen in FIGS. 3 and 4 that the top and bottom sections $1^1$ and $1^2$ are each other's mirror images and the guide wheel sets 100 at the top and at the bottom are identical. The guide wheel set 100 comprises three wheels 33, 34 and 35 and a wheel set axle 3. which is immovably attached to the side 28,29 of the sliding element 2, i.e., perpendicularly against the frame section 31,32. The wheels 33, 34 and 35 are rotatably carried on the axle 3, which owing to the design is also the hinge axle about which the element can be turned. Inside the box-type guide section $1^1$,$1^2$, in its walls, are provided fluted guiding grooves 36, 37,38 parallel to the guide section, against which the wheels 33, 34 and 35 alternatingly rest with their opposed sides. It is thus understood that the wheel set 100 travels inside the guide section $1^1$,$1^2$ and surrounded by it. The guide sections $1^1$,$1^2$ are advantageously aluminium sections made by an extrusion process.

In FIGS. 3–6 is seen an embodiment of the hinge arrangement of the invention. The hinge arrangement comprises a first coupling member 4, connected to the hinge axle 3, and a second coupling member 5, attached to the guide section $1^1$,$1^2$. When the first coupling member 4 is in register with the second coupling member 5, these coupling members 4 and 5 become coupled with each other, whereby the coupling members 4 and 5 lock the hinge axle 3 to be immovable relative to the guide section $1^1$, in order that the sliding element 2 can be turned. Although in this exemplary embodiment the hinge arrangement is shown as implemented on both opposed sides of the sliding element 2, such is in no way mandatory in every embodiment: the hinge arrangement may equally be provided on one side only.

In the embodiment of FIGS. 3–6, the hinge arrangement comprises a coupling piece 6, affixed to the guide section $1^1$,$1^2$. A second coupling piece 5 is provided on this coupling piece 6. The first coupling piece 6 comprises a slide member 7, on the hinge axle, this slide member consisting of a chisel-shaped portion 7 formed on the end of the hinge axle 3. The coupling piece comprises an elongated guiding slot 8 which forms, together with the slide member, a pair of guides for guiding the hinge axle into coupling engagement with the second coupling member 5. The second coupling member 5 comprises a round turning sleeve 9 with a diametral, through-going slot 10, disposed to receive in itself the slide member 7. The coupling piece 6 comprises a recess 11, in which the turning sleeve 9 is disposed to be turnable.

Figure 6:
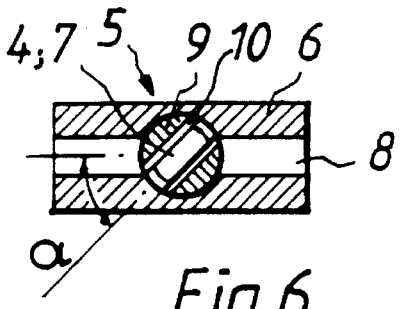
FIG. 6 shows a section like that of FIG. 5, when the sliding element has been turned to an angle $\alpha$.
Figure 5:
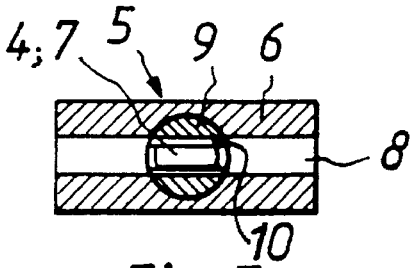
FIG. 5 shows the section V—V of FIG. 4.

In FIGS. 3, 4 and 5 the hinge arrangement is presented in a situation in which the coupling members 4 and 5 have become coupled so that when one begins to turn the sliding element 2 from this state in a direction perpendicular against the plane of the drawing, the hinge axle 3 will be held firmly in place during the turning motion, preventing any sidewise movement of the sliding element 2 at the opening phase. Advantageously, a console 39 is mounted on the lower guide section $1^2$, which supports the sliding element 2 at the beginning of its opening and makes sure that the chisel-like end 7 of the axle 3 stays within the turning sleeve 9 until the walls of the recess 11 give support to the sides of the chisel-like end 7 of the hinge axle 3. As shown in FIG. 6, in the further course of the opening movement the hinge axle 3 rests firmly against the walls of the recess 11 and cannot move sideways.

Figure 7:
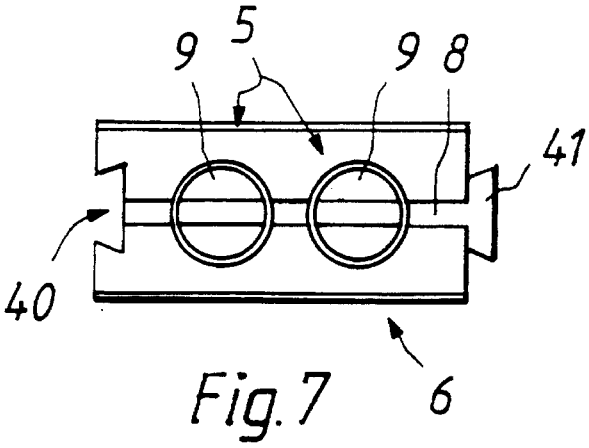
FIG. 7 presents the coupling piece comprised in another embodiment of the hinge arrangement of the invention, in top view.

FIG. 7 presents, in top view, the coupling piece 6 of another embodiment of the hinge arrangement of the invention.

Figure 8:
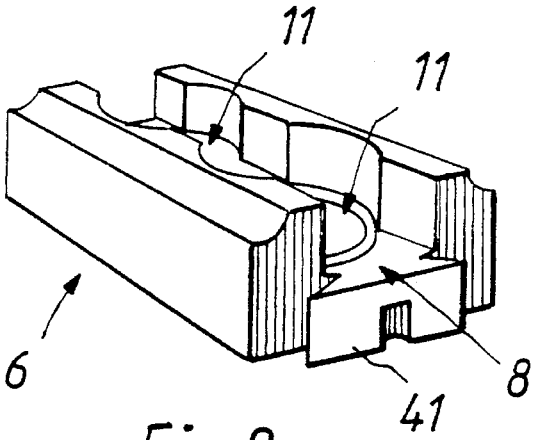
FIG. 8 presents in perspective the coupling piece of FIG. 8.

FIG. 8 presents, in perspective, the same coupling piece 6 without turning sleeves. The coupling piece 6 comprises here two second coupling members 5. Of course, any appropriate number of such elements may be provided on the coupling piece 6. In the centre of the coupling piece 6 is provided a guiding slot 8 for the slide member 7, i.e., for the chisel-like end 7 of the hinge axle 3. The turning sleeves 9 are seen, in FIG. 7, in a position in which the chisel-like end 7 of the hinge axle 3 can pass along the guiding slot 8 into coupling position in the slot 10 of the turning sleeve 9. The guiding slot 8 runs all the way through the coupling piece 6 in order that the sliding element 2 might be conveyable past the hinging point if desired. On the ends of the coupling piece 6 may advantageously be formed swallow tails 40 and 41 by the aid of which coupling pieces 6 can be joined one after the other in such number as may be desired, and which are then fixedly attached to the guide section $1^1$,$1^2$.

Figure 9:
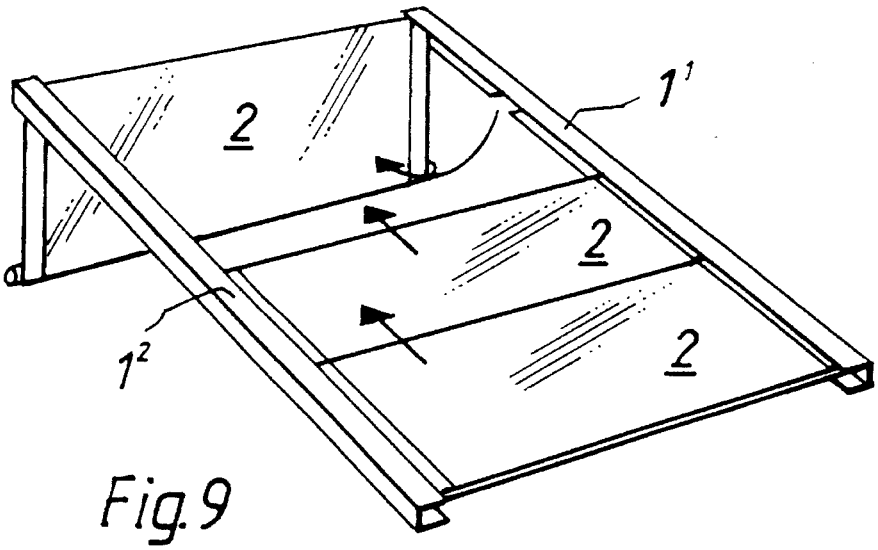
FIG. 9 presents another application in practice of the hinge arrangement of the invention.
Figure 10:
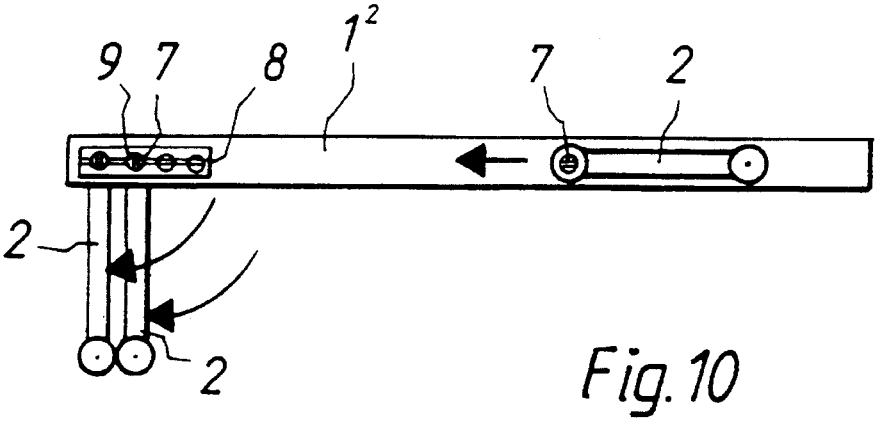
FIG. 10 presents, schematically and in elevational view, the application of FIG. 9.

FIG. 9 presents a practical application in which the hinge arrangement of the invention is used in order to turn from a canopy to the side, in opened position, glass elements 2 installed at an inclination in a horizontal plane. FIG. 10 presents a practical application for turning from a canopy to the side, in opened position, glass elements 2 installed in a horizontal plane. On these, it is recommendable to install hinge arrangements on the sides of the glass elements adjacent to both guide sections $1^1$,$1^2$ in order to preclude lateral slipping of the glass panes 2.

Figure 11:
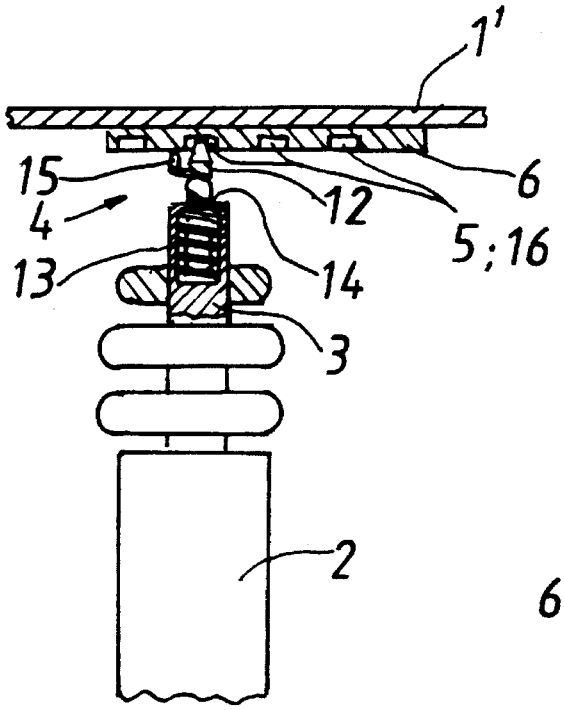
FIG. 11 presents schematically a third embodiment of the hinge arrangement, wherein the locking pin emerges from within the axle as the element is turned into opened position.

In FIG. 11 is seen an embodiment of the hinge arrangement wherein the first coupling member 4 comprises a locking pin 12 disposed inside the hinge axle 3. A compression spring 13 is provided for urging the locking pin 12 outward into a position in which it is pushed out from the hinge axle 3, and a locking member 14 for detachably locking the locking pin in its pushed-in position, against the spring bias. The arrangement includes a releasing member 15 for releasing the locking pin and allowing the locking pin to get free of its locking and to assume a pushed-out position. The coupling piece 6, on which the second coupling member 5 has been provided, is affixed to the guide section $1^1$. The second coupling member 5 is a recess 16 formed in the coupling piece 6, which can receive the end of the locking pin 12, advantageously tapered, in itself. When the element 2 is being opened, the locking pin 12 is set free from retention by the tongue 14 and is pushed out by spring force, and turning is then feasible with the hinge axle 3 remaining stationary in the coupling piece 6, as the tapered end of the locking pin 12 enters the recess 16 in the coupling piece 6. On closing the element 2, the guide will force the pin into the hinge axle. most advantageously under control of a thread provided on the locking pin.

Figure 12:
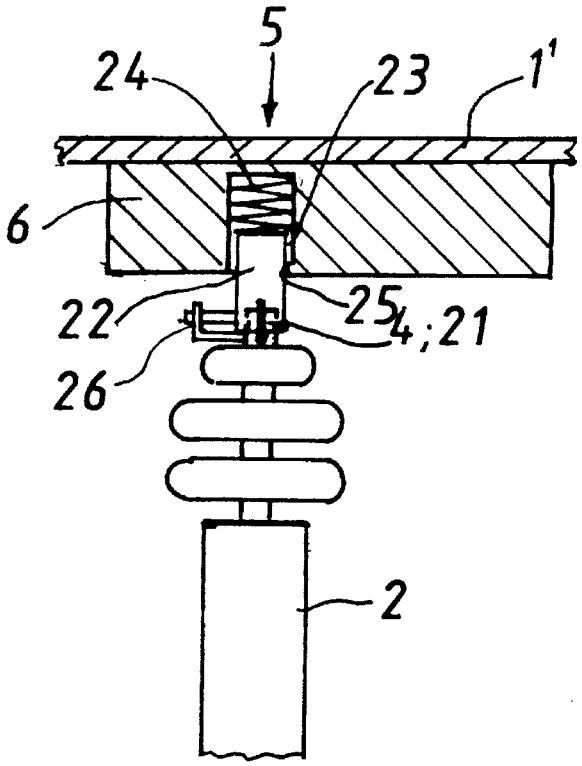
FIG. 12 presents schematically a fourth embodiment of the hinge arrangement, wherein the hinge sleeve emerging from within the locking piece locks the hinge axle as the element is turned into opened position.

FIG. 12 shows an embodiment of the hinge arrangement in which the first coupling member 4 comprises the hinge axle end 21 and the second coupling member 5 comprises a pin 22, disposed to receive in itself the end 21 of the hinge axle. The pin 22 is arranged to be movable, and turnable, in a recess 23 in the coupling piece 6. The arrangement includes a compression spring 24 serving to urge the hinge sleeve outward from the recess into a pushed-out position, and a locking member 25 for locking the pin 22 in its pushed-in position against the spring bias. The task of the releasing member 26 is to release the pin 22 so that it is free to go into the pushed-out position into coupling engagement with the end 21 of the hinge axle. The outward pushing pin 22 on the coupling piece 5 is set free to go into locked position when the element 4 is turned sideways whereby the releasing member, or tongue, 25 releases the pin 22, which is urged outward with appropriate force by the compression spring 24. When the element 2 is being closed, the tongue 25 will press the pin 22, with the aid of a helical groove thereon provided, back into closed position, the sliding element 2 being set free from the coupling piece 6 and being thereafter movable sideways, along the guide sections.

Figure 13:
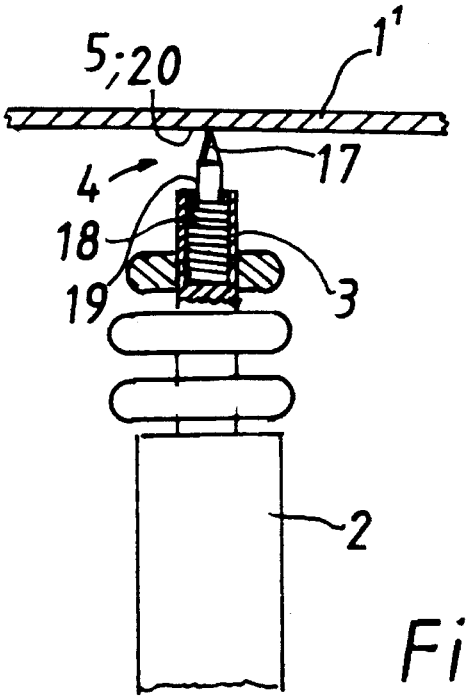
FIG. 13 presents schematically a fifth embodiment of the hinge arrangement, wherein the locking pin emerges from within the hinge axle and against the guide section as the element is turned into opened position.

FIG. 13 shows an embodiment of the hinge arrangement in which the first coupling member 4 comprises a pointed locking pin 17, disposed inside the hinge axle 3. A compression spring 18 exerts pressure on the locking pin 17 to urge it outward from the hinge axle 3, into pushed-out position. The arrangement further includes a locking member 19, by which the locking pin 17 can be detachably locked in its pushed-in position against the spring bias. The second coupling member 5 is the surface 20 of the guide section, against which the locking pin 17 is pressed in its pushed-out position and with which the point of the pin engages, holding the hinge axle in place while the element 2 is being turned. The spring force may be so dimensioned that the tip of the pointed locking pin 17 slightly enters the guide section surface 20, making a small indentation therein. The surface 20 of the guide section may of course be provided with pre-fashioned dents in which the tip of the locking pin 17 may engage.

The hinge arrangement of the invention can also be applied advantageously in order to facilitate the function of sliding element systems resembling a lifting door in such spaces where the roof/ceiling area is too short to allow the whole wall section to be run into a position parallelling the roof/ceiling. It is also appropriate to be used in order to facilitate the opening of lifting doors in the case of which the roof/ceiling is located rather high up and elaborate supporting structures would otherwise be required in order to support the running rails for the lifting door, to secure the door rails in their proper place. In these cases only a short set of rails is needed in extension of the door, which will be sufficient for opening the bunched elements on one side with a side-hinged arrangement. In that case the elements will remain freely suspended by one side, carried on the guide rails by the locking pieces of their hinges.

The invention is not exclusively delimited to concern the embodiment examples presented in the foregoing: numerous modifications are feasible within the scope of the inventive idea defined by the claims. It should be noted in particular that coupling members conforming to the hinge arrangement of the invention can be installed inside various types of section, independent of the method and the kind of wheel sets with the aid of which the elements are moved. The coupling member may also be made partly or completely movable in the sections, if required.

I claim:

1. A hinge arrangement for hinging a rectangular sliding element movable in guidance of, and carried by, a pair of stationary guide sections for turning about a hinge axle affixed to said sliding element, the sliding element having a first side and a second side substantially parallel to each other, and a guide wheel set is attached on each of said first side and said second side of the sliding element, each guide wheel set including a number of wheels and a wheel axle on which the wheels are rotatably carried one after another to be separately rotatable, and said wheel axle being respectively fixed at right angles to the first and the second side of the sliding element, and planes of rotation of said wheels being substantially perpendicular to a plane of said sliding element, and said stationary pair of guide sections including a first box-type guide section located on said first side of the sliding element and a second box-type guide section located on said second side of the sliding element, and the guide sections include supports arranged at an inner wall of each guide section parallel to the guide section, for guiding and carrying said guide wheel set on said first and second side, whereby opposite sides of said wheels alternatingly rest against said supports, the hinge arrangement comprising:

a first coupling member formed at an end of said wheel axle, said wheel axle being said hinge axle for the sliding element; and a second coupling member, affixed to the guide section, wherein the first coupling member and the second coupling member are arranged to become coupled with each other when the first coupling member is in register with the second coupling member, and thus to lock the wheel axle relative to the guide section to be substantially immovable, for the turning of said sliding element.

2. The hinge arrangement according to claim 1, wherein the hinge arrangement comprises a coupling piece, affixed to the guide section, on which the second coupling member is provided.

3. The hinge arrangement according to claim 1, wherein the first coupling member comprises a slide member at the hinge axle, and a coupling piece comprises an elongated guide, said elongated guide and said slide member forming a pair of guides for guiding the hinge axle into coupling engagement with the second coupling member.

4. The hinge arrangement according to claim 3, wherein the slide member is a chisel-like portion formed on an end of the hinge axle, and the elongated guide is a slot.

5. The hinge arrangement according to claim 4, wherein the second coupling member comprises a round turning sleeve having a diametral slot passing through it and disposed to receive in itself the slide member and the coupling piece comprises a first recess in which the turning sleeve is disposed to be turnable.

6. The hinge arrangement according to claim 5, wherein the coupling piece comprises in succession two or more second coupling members.

7. An arrangement for hinging a rectangular sliding element, comprising:

a hinge axle affixed to the sliding element;

a pair of stationary guide sections for turning about the hinge axle including a first box-type guide section located on a first side of the sliding element and a second box-type guide section located on a second side of the sliding element;

a plurality of guide wheel sets attached on the first and second sides of the sliding element, each guide wheel set including a wheel axle and a plurality of wheels coupled to the wheel axle to be separately rotatable about the wheel axle, the wheel axle being fixed at right angles with respect to the first and second sides of the sliding element, the wheels having planes of rotation substantially perpendicular to a plane of the sliding element;

a plurality of supports arranged at inner walls of the first box-type guide section and the second box-type guide section for guiding and carrying the guide wheel sets, opposite sides of the plurality of wheels alternatingly resting against the supports;

a first coupling member formed at an end of the wheel axle, the wheel axle forming the hinge axle for the sliding element; and a second coupling member coupled to the box-like guide sections, the first coupling member and the second coupling member being arranged to become coupled with each other when the first coupling member is in register with the second coupling member to lock the wheel axle to be substantially immovable relative to the box-type guide section when turning the sliding element.

* * * * *